US006873791B2

(12) United States Patent
Cheng

(10) Patent No.: US 6,873,791 B2
(45) Date of Patent: Mar. 29, 2005

(54) RETAINING DEVICE OF HEAT BLOWER

(76) Inventor: Chuan-Hsin Cheng, 235 Chung-Ho Box 8-24, Taipei (TW)

( * ) Notice: Subject to any disclaimer, the term of this patent is extended or adjusted under 35 U.S.C. 154(b) by 383 days.

(21) Appl. No.: 10/174,864

(22) Filed: Jun. 20, 2002

(65) Prior Publication Data

US 2003/0235462 A1 Dec. 25, 2003

(51) Int. Cl.[7] ..... F24H 3/00

(52) U.S. Cl. ..... 392/382; 392/385; 219/242; 248/188.8

(58) Field of Search ..... 392/382–385, 392/365–369, 373–374; 248/188.8–188.9, 188.91, 677, 685, 424; 34/96–97, 91; 219/242

(56) References Cited

U.S. PATENT DOCUMENTS 1,716,580 A * 6/1929 Duhamel ..... 219/520
2,662,962 A * 12/1953 Green ..... 30/140
2,678,376 A * 5/1954 Lockwood ..... 392/385
3,184,195 A * 5/1965 Wahl et al. ..... 248/158
3,587,453 A * 6/1971 Klein et al. ..... 101/480
4,635,811 A * 1/1987 Lodi ..... 220/629

* cited by examiner

*Primary Examiner*—John A. Jeffrey

(57) ABSTRACT

A retaining device of a heat blower comprises two sliding grooves and two wings. Each of two sides at a rear end of a casing of the heat blower is formed with one of the two sliding grooves. Each of an upper and a lower ends of each wing has an elastic hook, respectively. By pressing the elastic hooks. The wings are embedded into respective sliding groove, and the wings are slidable with respect to the sliding groove. The wings can be pushed to move outwards to predetermined positions so as to increase the coverage and stability of the heat blower. The wings can be pushed inward along the sliding grooves for operation as being held by a user or for storage.

4 Claims, 7 Drawing Sheets

RETAINING DEVICE OF HEAT BLOWER

FIELD OF THE INVENTION

The present invention relates to heat blowers, and particularly to a retaining device of a heat blower, wherein the heat blower has wings installed at the casing. The wings are capable of being pushed to move outwards to predetermined positions so as to increase the coverage and stability of the heat blower.

BACKGROUND OF THE INVENTION

Heat blowers are widely used in industry. In general, the heat blower is installed with high impedance heat resistors. Heat generated from the heat resistor is blown out by a fan. Thereby, the heat blower can heat a work piece. In general the heat blower is held by a hand for blowing hot air to an object, while in many cases, the heat blower is placed flatly, as shown in the FIG. 1, and the work piece is held by the hand of the operator to move reciprocally. If the heat blower is unused, it is placed uprightly. Currently, to carry the heat blower conveniently, in general, the bottom of heat blowers are made small and the volume is also small, but in order to increase the efficiency of the heat blower, the temperature of the blowing air is high, even has a temperature of 500 to 600° C. at the output of the heat blower. The heat will be accumulated at the output of the heat blower. Furthermore, the heat will transfer to other portion of the casing of the heat blower. Since the bottom of a heat blower is smaller, if it is placed uprightly, it easily falls down so as to hurt those standing aside. Moreover, fire accident will occur.

SUMMARY OF THE INVENTION

Accordingly, the primary object of the present invention is to provide a retaining device of a heat blower comprising two sliding grooves and four wings. Each of two sides at a rear end of a casing of the heat blower is formed with one of the two sliding grooves. Each of an upper and a lower ends of each wing has an elastic hook, respectively. By pressing the elastic hooks. The wings are embedded into respective sliding groove, and the wings are slidable with respect to the sliding groove. The wings are capable of being pushed to move outwards to predetermined positions so as to increase the coverage and stability of the heat blower. The wings are capable of being pushed inward along the sliding grooves for operation as being held by a user or for storage.

Another object of the present invention is to provide a retaining device of a heat blower, wherein each of an upper and a lower ends of each wing has an elastic hooks; when the elastic hooks are pressed, the wing will embed into a respective sliding groove, when the wing is pushed outwards to a predetermined position, the elastic hooks is buckled to an inner wall of the casing and thus the wings are limited.

A further object of the present invention is to provide a retaining device of a heat blower, wherein a center of the protruding edge is extended with a protuberance; a positioning hole is formed in the casing. When the wing is pushed inwards along the sliding groove and is stored within the heat blower; the protuberance is exactly buckled in the positioning hole. Thus, when the user holds the heat blower for blowing wind to an object, the wings will not protrude out due to the movement of the heat blower.

The various objects and advantages of the present invention will be more readily understood from the following detailed description when read in conjunction with the appended drawing.

DETAILED DESCRIPTION OF THE PREFERRED EMBODIMENTS

Figure 6:
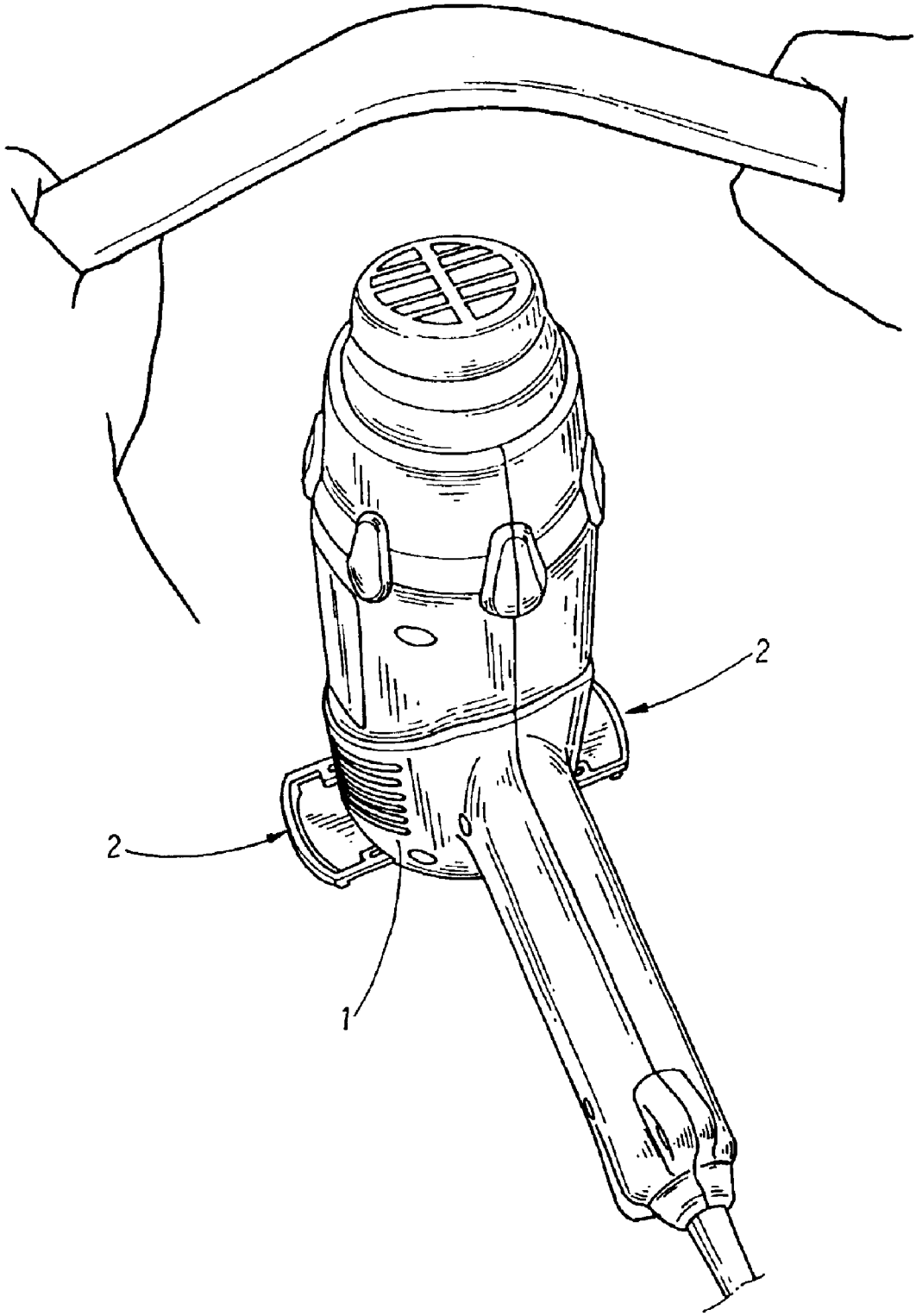
FIG. 6 is a lateral view of the present invention which is placed uprightly.
Figure 7:
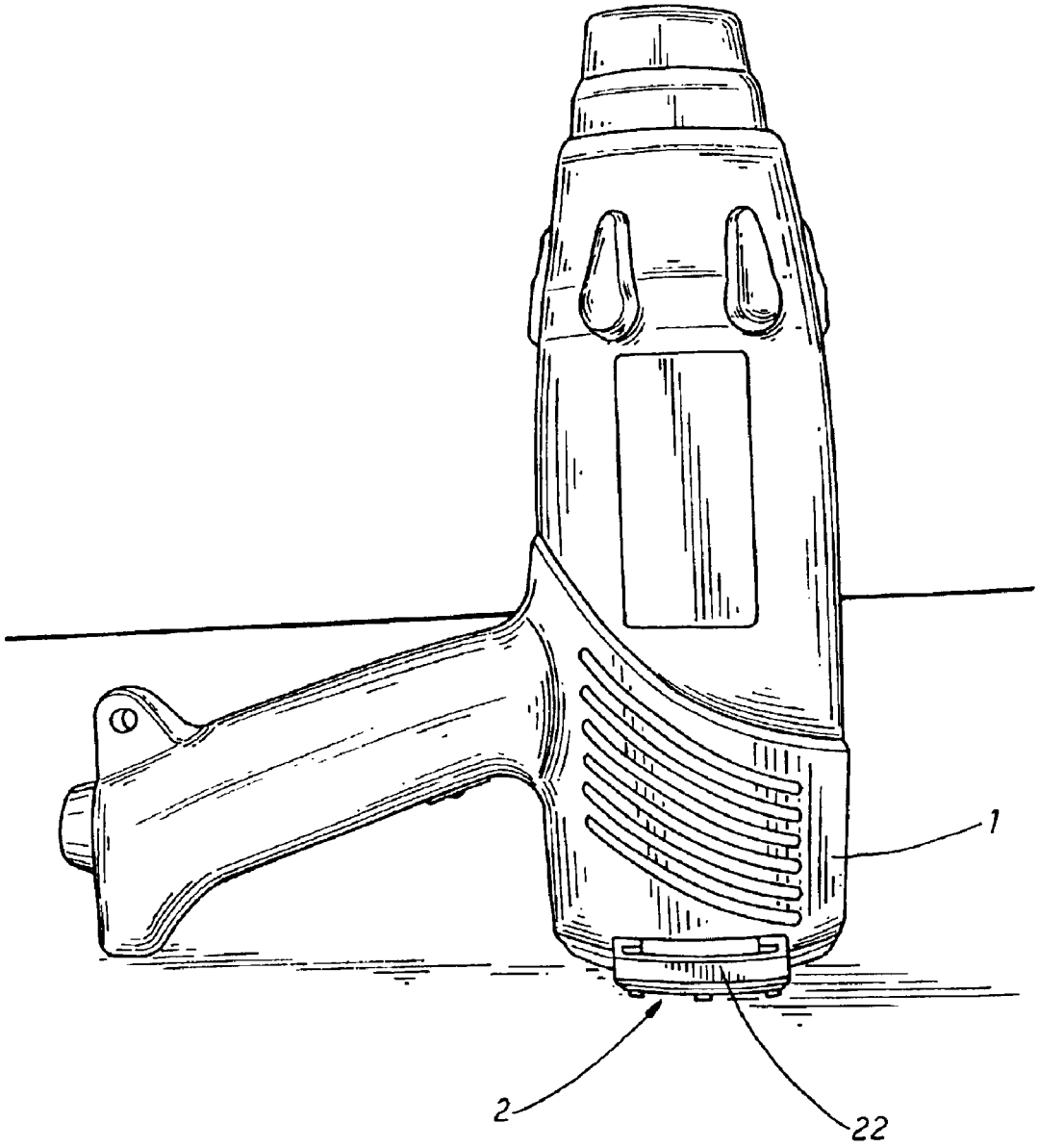
FIG. 7 is a schematic view showing the operation of the present invention.
Figure 8:
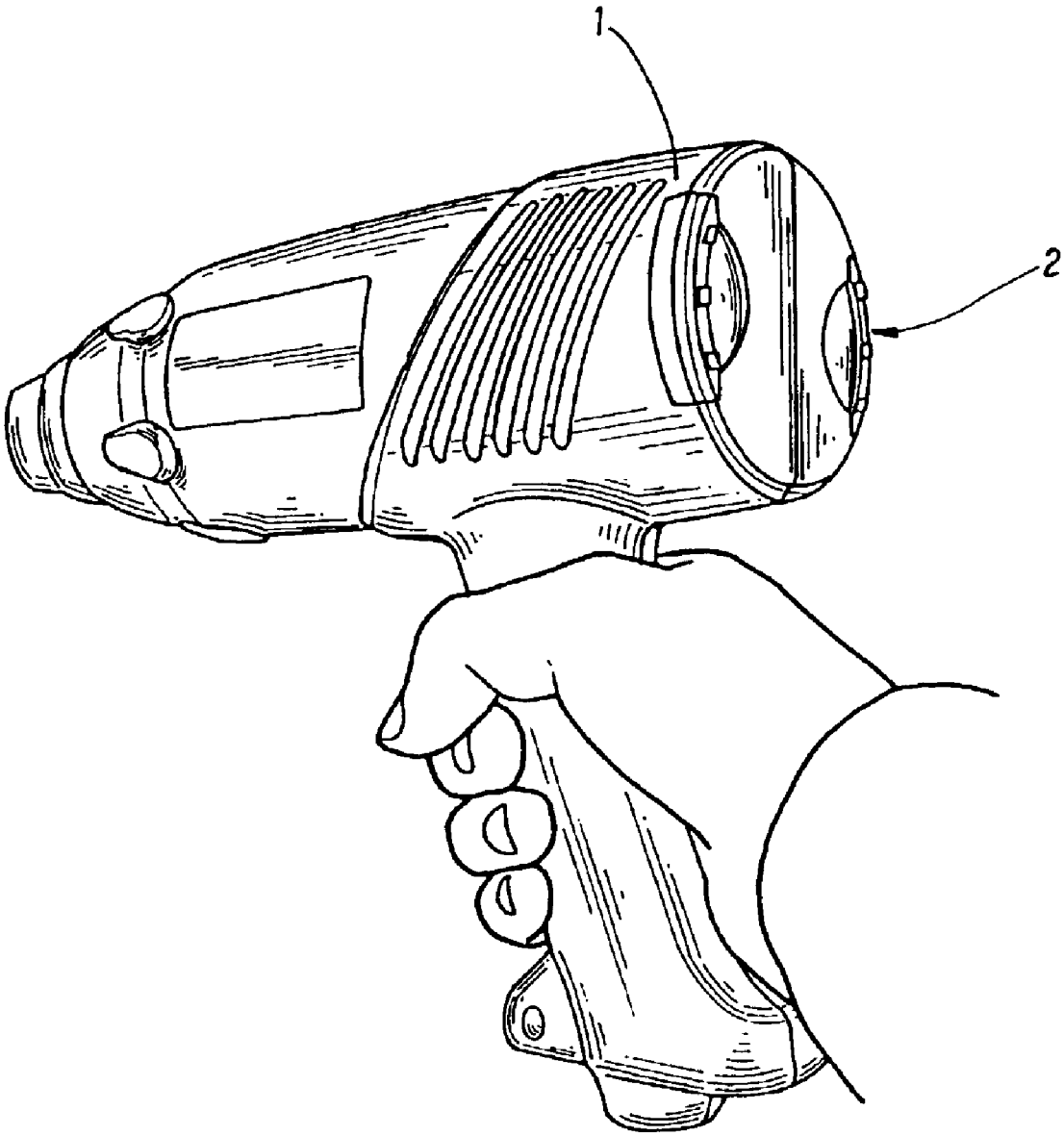
FIG. 8 is a schematic view showing that the heat blower is held by the user according to the present invention.

With reference to FIGS. 2 to 5, the retaining device of a heat blower of the present invention is illustrated. Two sides at a rear end of the casing 1 of a heat blower are installed with two sliding grooves 11. There are two wings 2. The upper and lower ends of each wing 2 have elastic hooks 21. By pressing the elastic hooks 21, the wing 2 can be embedded into a respective sliding groove 11, and the wing 2 is slidable with respect to the sliding groove 11. The wing 2 can be pushed so as to move outwards to a predetermined position. The elastic hooks 21 are buckled to the inner wall of the casing 1 and provides a maximum moving limitation to the wings 2. By above feature, when the heat blower is placed flatly (referring to FIGS. 6 and 7), the wings 2 can be pushed outwards to predetermined positions so as to increase the coverage area of the casing and the stability of the heat blower. Thereby, the heat blower will not fall down during operation. Contrary, when the user holds the heat blower to blow wind to an object (referring to FIG. 8), or to store the heat blower, the wings 2 can be pushed inwards along the sliding grooves 11 and then is stored in the heat blower.

Figure 1:
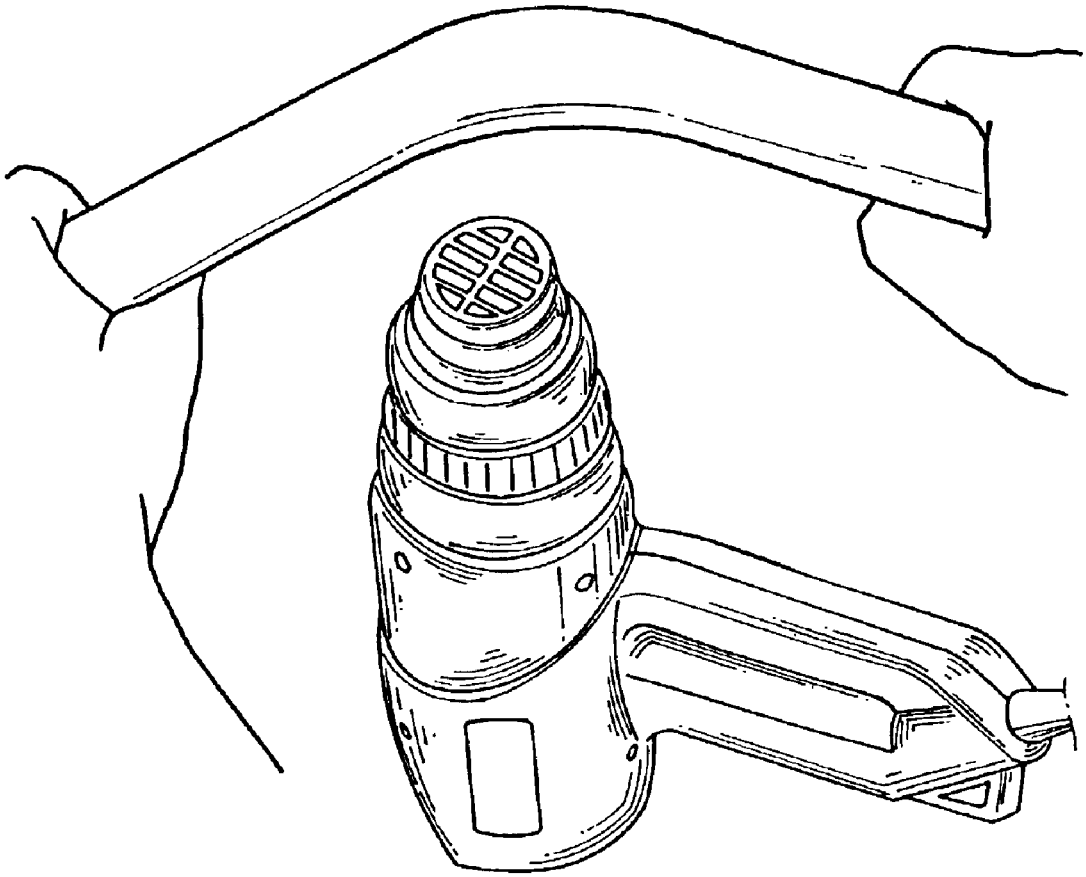
FIG. 1 PRIOR ART
FIG. 1 is a schematic view of a prior art stand type heat blower.
Figure 2:
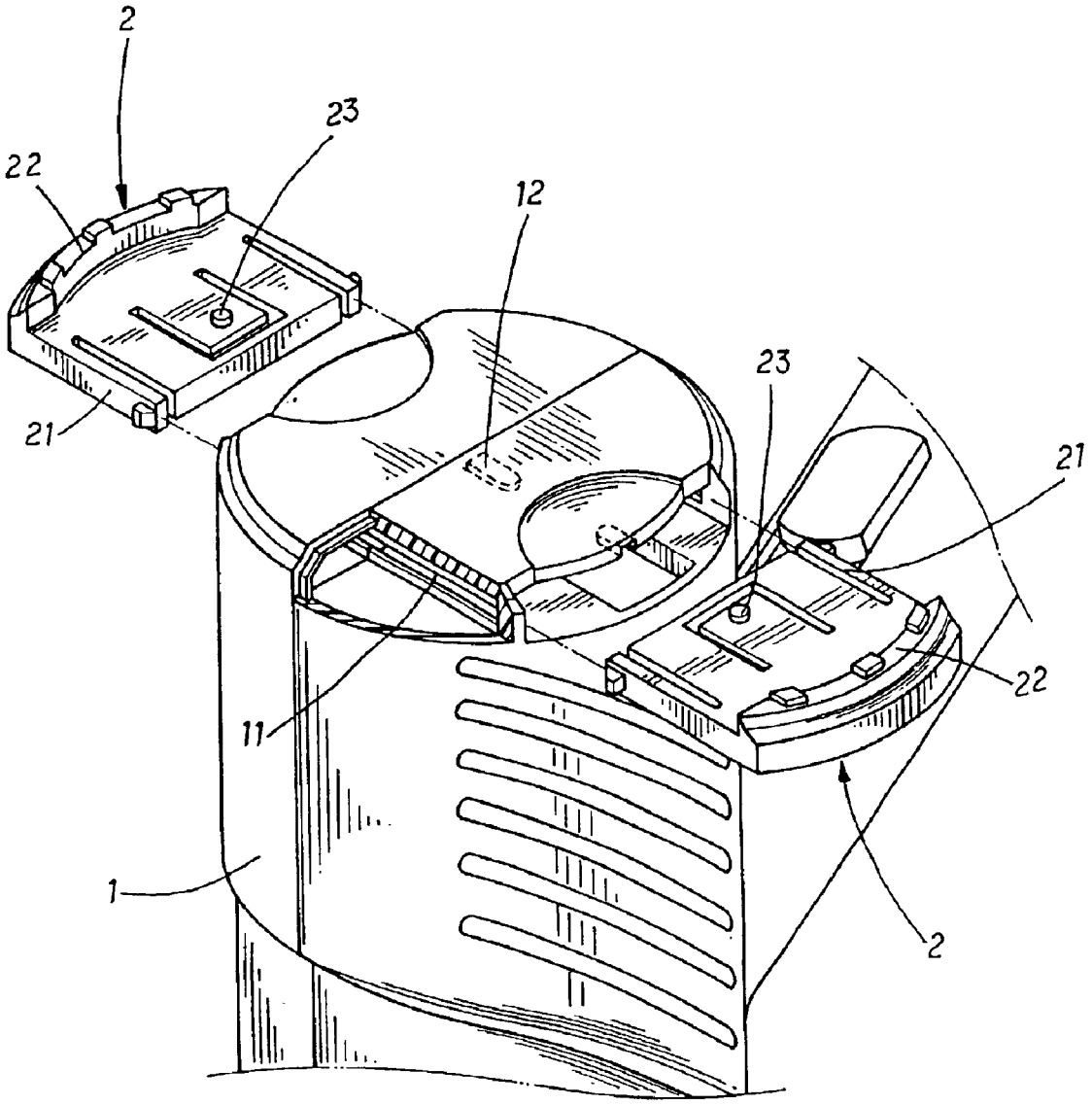
FIG. 2 is an exploded perspective view of the present invention.
Figure 3:
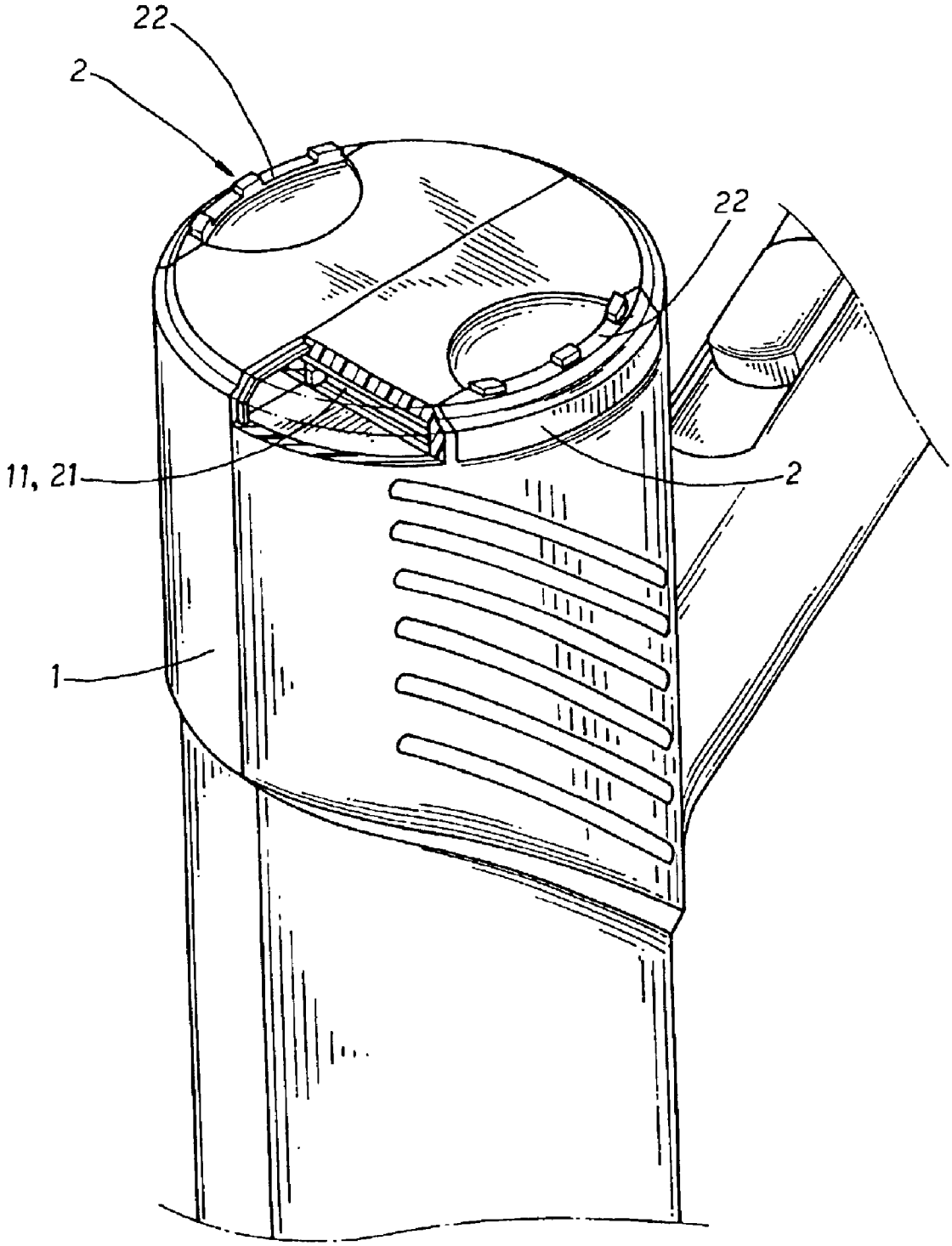
FIG. 3 is an assembled perspective view of the present invention.
Figure 4:
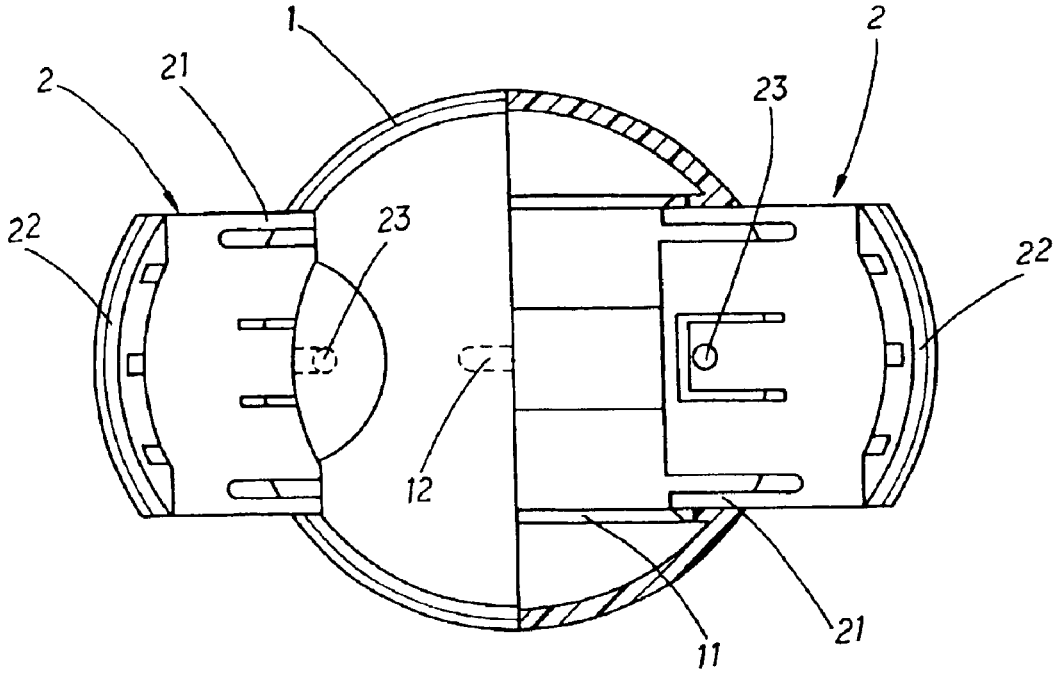
FIG. 4 is a rear view of the present invention showing that the wings of the present invention expands outwards.
Figure 5:
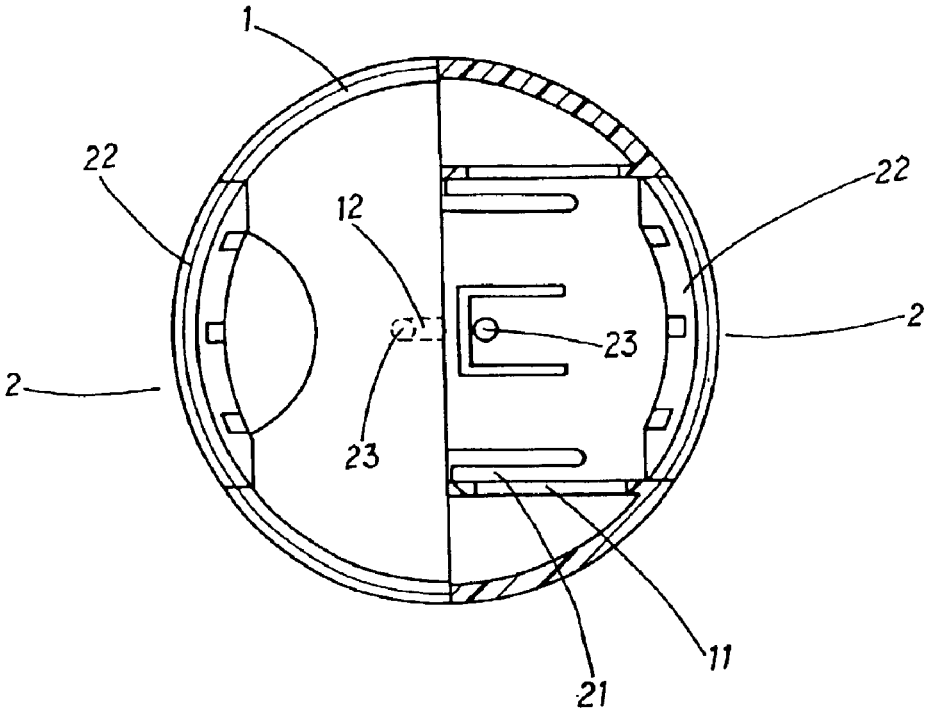
FIG. 5 is a rear view of the present invention showing that the wings of the present invention are within the casing of a heat blower.

Referring to FIGS. 2 and 4, a rear side of each wing 2 has a protruding edge 22. A user may apply a force conveniently to the protruding edge 22 so as to move the wing 2. When the wing 2 is pushed outwards to a predetermined position and the heat blower is placed flatly (referring to FIG. 6). The protruding edges 22 will support the heat blower to the predetermined position so as to have a preferred stability.

Moreover, a center of the protruding edge 22 is extends with a protuberance 23. A positioning hole 12 is formed in the casing 1. When the wing 2 is pushed inwards along the sliding groove 11 and is stored within the heat blower (referring to FIG. 5). The protuberance 23 is exactly buckled in the positioning hole 12. Thus, when the user holds the heat blower for blowing wind to an object, the wings 2 will not protrude out due to the movement of the heat blower.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A retaining device of a heat blower; the heat blower having a casing; said retaining device comprising:

two sliding grooves; each side of a rear end of the casing having a sliding groove;

two wings; each wing having two ends; and each end of each wing having an elastic hook;

wherein by pressing the elastic hooks, the wings are embedded into respective sliding grooves, and the wings are slidable with respect to the sliding grooves; the wings can be pushed to move outwards to predetermined positions for increasing the coverage and stability of the heat blower; the wings are capable of being pushed inward along the sliding grooves for operation or for storage.

2. The retaining device of a heat blower as claim in claim 1, wherein each of an upper and a lower ends of each wing has elastic hooks; when the elastic hooks are pressed, the wing will embed into the respective sliding groove, when the wing is pushed outwardly to a predetermined position, the elastic hooks are buckled to an inner wall of the casing and thus the wings are limited.

3. The retaining device of a heat blower as claim in claim 1, wherein a rear side of each wing has a protruding edge; thereby, when a force is applied to the protruding edge, the wing moves; when the wing is pushed outwards to a predetermined position and the heat blower is placed flatly; the protruding edges will support the heat blower to the predetermined position so as to have a preferred stability.

4. The retaining device of a heat blower as claim in claim 1, wherein a center of the protruding edge includes a protuberance; a positioning hole is formed in the casing, such that when the wing pushes inwardly along the sliding groove and stores within the heat blower; the protuberance is received in the positioning hole; thus, when the user holds the heat blower for blowing wind to an object, the wings will not protrude out due to the movement of the heat blower.

* * * * *